US012121961B2

(12) United States Patent
Gerner et al.

(10) Patent No.: US 12,121,961 B2
(45) Date of Patent: Oct. 22, 2024

(54) DIE-CASTING MACHINE HAVING A SHUT-OFF VALVE IN THE MELT INLET CHANNEL AND OPERATING METHOD

(71) Applicant: Oskar Frech GmbH + Co. KG, Schorndorf (DE)

(72) Inventors: Daniel Gerner, Moegglingen (DE); Andreas Sydlo, Urbach (DE)

(73) Assignee: Oskar Frech GmbH + Co. KG, Schorndorf (DE)

( * ) Notice: Subject to any disclaimer, the term of this patent is extended or adjusted under 35 U.S.C. 154(b) by 0 days.

(21) Appl. No.: 18/266,522

(22) PCT Filed: Dec. 1, 2021

(86) PCT No.: PCT/EP2021/083722
§ 371 (c)(1),
(2) Date: Jun. 9, 2023

(87) PCT Pub. No.: WO2022/122496
PCT Pub. Date: Jun. 16, 2022

(65) Prior Publication Data

US 2023/0398602 A1 Dec. 14, 2023

(30) Foreign Application Priority Data

Dec. 10, 2020 (DE) ..... 10 2020 215 665

(51) Int. Cl.
*B22D 17/32* (2006.01)
*B22D 17/02* (2006.01)
*B22D 17/20* (2006.01)

(52) U.S. Cl.
CPC ..... *B22D 17/32* (2013.01); *B22D 17/02* (2013.01); *B22D 17/203* (2013.01); *B22D 17/2069* (2013.01)

(58) Field of Classification Search
CPC ..... B22D 17/02; B22D 17/20; B22D 17/203; B22D 17/2069; B22D 17/32
(Continued)

(56) References Cited

U.S. PATENT DOCUMENTS

2003/0029596 A1 2/2003 Fink
2014/0319188 A1 10/2014 Kusic
(Continued)

FOREIGN PATENT DOCUMENTS

CN 105935754 A 9/2016
DE 3248423 A1 6/1984
(Continued)

OTHER PUBLICATIONS

International Search Report (PCT/ISA/210) issued in PCT Application No. PCT/EP2021/083722 dated Feb. 23, 2022 with English translation (4 pages).
(Continued)

*Primary Examiner* — Kevin P Kerns
(74) *Attorney, Agent, or Firm* — Crowell & Moring LLP

(57) ABSTRACT

A method for carrying out a casting process of a die-casting machine includes, for a mould-filling phase, to bring the shut-off valve into a closed position, and to control the casting piston in the casting chamber to advance from a casting start position to a filling end position, and, for a subsequent refilling phase, to bring the shut-off valve into an open position and to control the casting piston to move back to the casting start position. A closure nozzle is provided in the melt outlet channel and kept closed in the refilling phase. In the mould-filling phase, the casting piston is firstly moved back from the casting start position to an additional stroke position and subsequently advance from the additional
(Continued)

stroke position via the casting start position to the filling end position. The closure nozzle is only opened when the casting piston advances again.

5 Claims, 5 Drawing Sheets

(58) Field of Classification Search
USPC ..... 164/457, 113, 316
See application file for complete search history.

(56) References Cited

U.S. PATENT DOCUMENTS

| | | | |
|---|---|---|---|
| 2014/0345824 | A1 | 11/2014 | Fahrenbach et al. |
| 2017/0008078 | A1 | 1/2017 | Segaud et al. |
| 2019/0054522 | A1 | 2/2019 | Kusic |

FOREIGN PATENT DOCUMENTS

| | | | |
|---|---|---|---|
| EP | 0 576 406 | B1 | 9/1997 |
| EP | 1 284 168 | B1 | 12/2005 |
| EP | 2 808 104 | A1 | 12/2014 |
| WO | WO 02/085560 | A1 | 10/2002 |
| WO | WO 2013/071926 | A2 | 5/2013 |
| WO | WO 2015/144398 | A1 | 10/2015 |
| WO | WO 2017/148457 | A1 | 9/2017 |

OTHER PUBLICATIONS

German-language Written Opinion (PCT/ISA/237) issued in PCT Application No. PCT/EP2021/083722 dated Feb. 23, 2022 (8 pages).
German-language Office Action issued in German Application No. 10 2020 215 665.4 dated Jul. 13, 2021 (6 pages).

DIE-CASTING MACHINE HAVING A SHUT-OFF VALVE IN THE MELT INLET CHANNEL AND OPERATING METHOD

BACKGROUND AND SUMMARY

The invention relates to a method for operating a die-casting machine having a casting mould, a casting chamber, a casting piston arranged in an axially moveable manner in the casting chamber, a melt inlet channel which leads into the casting chamber and has a shut-off valve, and a melt outlet channel which leads from the casting chamber to the casting mould, wherein, for carrying out a respective casting process, in a mould-filling phase, with the shut-off valve being closed, the casting piston in the casting chamber is advanced from a casting start position to a filling end position and melt material is pressed into the casting mould via the melt outlet channel and, in a subsequent refilling phase, the casting piston is moved back into the casting start position, with the shut-off valve being open, so as to supply the casting chamber with melt material via the melt inlet channel, and to a die-casting machine suitable for carrying out this operating method.

Die-casting machines of this type, of the generic type and of similar types, and associated operating methods are generally used for casting a specific component, also referred to as cast part, in the respective casting process or casting cycle. The present die-casting machine, also referred to in short as machine below, and the present operating method are suitable in particular for metal die-casting, e.g. for casting liquid or partially liquid metal melts, such as zinc, lead, aluminium, magnesium, titanium, steel, copper, and alloys of these metals. The die-casting machine may be in particular a hot-chamber die-casting machine. In this implementation, the casting chamber is formed in a casting container which is immersed in a melt bath kept ready by a melt container.

In the mould-filling phase of the casting process, the advancement of the casting piston presses melt material, located in the casting chamber, under pressure out of the casting chamber into a mould cavity formed by the casting mould via the melt outlet channel, in order to form a corresponding cast part. In this respect, the casting mould usually contains a fixed and a moveable mould half, which between them form the mould cavity, also referred to as mould hollow space or, in a manner synonymous with this casting mould which is formed, mould for short. In typical implementations, the melt outlet channel comprises a riser-tube region of a casting container, which contains the casting chamber, on the inlet side and a mouthpiece body, which is attached to the casting container, on the outlet side and a mould-side outlet channel portion which extends in the fixed mould half as far as the mould cavity, i.e. after it leaves the casting chamber, the melt material passes via the riser-tube region and the mouthpiece body to a melt inlet or a gate region directly in front of the mould cavity, wherein the mould-side outlet channel portion has, for example, what is known as a gating cone as interface for the purpose of coupling to the mouthpiece body or branches, for example in the case of hot runner systems, and opens out with a plurality of parallel branches, in each case via a nozzle-shaped end region, into a gate region or into the mould cavity.

In the refilling phase, the casting piston is moved back again from its filling end position into its initial position, i.e. casting start position, and the return movement of the casting piston refills the casting chamber with melt material via the melt inlet channel. The refilling phase can therefore also be referred to as piston return phase.

In the case of a corresponding machine type, as is suitable in particular for the present die-casting machine, the melt outlet channel leads out of the casting chamber separately from the melt inlet channel, i.e. melt inlet channel and melt outlet channel form two separate guide channels for the melt material with a casting-chamber inlet, at which the melt inlet channel opens out into the casting chamber, and a separate casting-chamber outlet, at which the melt outlet channel opens out of the casting chamber. This configuration facilitates independent control of the melt flows in the melt inlet channel and in the melt outlet channel, the melt flow in the melt inlet channel specifically being able to be controlled by the shut-off valve located there.

Depending on the system configuration, it is possible to use, as shut-off valve, a non-return valve which is actuated purely by melt pressure or an actively activatable shut-off valve. The latter is referred to in the present case as shut-off control valve and is controlled by the control unit. In these die-casting machines of the generic type and associated operating methods, the shut-off control valve is usually kept closed during the entire mould-filling phase and kept open during the entire refilling phase. In comparison with a mere non-return valve, as an actively controllable or activatable shut-off valve it offers the option of influencing or regulating the melt throughflow in the melt inlet channel as required, this also independently of the melt pressure ratios in the casting chamber and/or in the melt inlet channel.

Depending on the system configuration, the control unit comprises a single control device in which all control functionalities of the die-casting machine are integrated, or a plurality of single control devices, each of which controls and/or regulates specific machine components and which preferably have a communication link with one another. In this case, as is customary, the control unit may be configured at least partially in hardware and/or at least partially as software. In the present case, the control unit controls in particular the casting piston, more precisely the movement thereof, and optionally one or more further machine components, such as in particular the shut-off control valve, if the shut-off valve is implemented by such a shut-off control valve.

Patent publication EP 0 576 406 B1 discloses a die-casting machine of the generic type which has a casting piston of the displacement type, as is known as an alternative to a casting piston of the spool type, and has a shut-off control valve arranged directly at an opening of the melt inlet channel into the casting chamber. In the case of the spool type, the outer dimension of the casting piston corresponds to the inner dimension of the casting chamber, the piston being sealed with respect to the casting chamber wall. Consequently, in this case, when it advances the casting piston pushes the melt material in the casting chamber completely forward and in the process exerts the pressure on the melt material required to press it into the mould cavity. In the case of the displacement type, the outer dimension of the casting piston is suitably smaller than the inner dimension of the casting chamber, and therefore the casting piston dips into the melt material of the casting chamber when it advances. The action of pressure on the melt material is brought about in this case by the displacement effect of the volume of the casting piston that dips into the melt material.

Laid-open publication DE 32 48 423 A1 discloses a die-casting machine and an associated operating method of the generic type mentioned at the outset, in which a casting piston with a forward piston of the displacement type and a pressurized gas which additionally can be fed to the casting chamber are used and the shut-off control valve is located in a casting container, containing the casting chamber, at a respective distance in terms of flow upstream of the casting chamber and downstream of an inlet into the casting container in the melt inlet channel. During the mould-filling phase, the shut-off control valve is kept closed. During the refilling phase, the shut-off control valve is opened and conducts a certain amount of pressurized gas into the casting chamber, in order, before the shut-off control valve is opened, to avoid the formation of a vacuum in the casting chamber and to avoid the spraying of melt which has been pulled in as a result onto the casting-piston part to the rear of the forward piston and to pressurize the gas pressure in the casting chamber by a certain amount above atmospheric pressure. After a required amount of melt has been fed during the refilling phase, the shut-off control valve is closed again.

Die-casting machines of an alternative machine type to the generic type which do not have a shut-off valve in the melt inlet channel are also known, wherein the melt inlet channel then typically opens out into the casting chamber in a region that can be overrun by a casting piston of the spool type, and therefore the casting piston, which moves back and forth in the casting chamber, simultaneously functions as shut-off member for the melt inlet channel into the casting chamber. The movement path of the casting piston from a rear end position until it reaches the opening of the melt inlet channel into the casting chamber is used in these machines as acceleration path, on which the casting piston can be accelerated before it then presses the melt out of the casting chamber via the melt outlet channel into the mould.

In order to in this machine type obtain a short cycle time, i.e. duration of a respective casting process, which is sought for economic reasons, and for reasons relating to the quality of the cast part an air fraction in the cast part which is as low as possible, i.e. a minimum air porosity of the cast part, patent publication EP 1 284 168 B1 proposes, at the beginning of the mould-filling phase and/or before the actual mould-filling phase, in a pre-filling phase to advance the casting piston already when the mould is still open far enough that the melt material fills the riser-channel region and the mouthpiece body region, before the mould is then closed and the casting piston is advanced again to carry out the actual mould-filling phase.

For this machine type, machine implementations having a closure nozzle in the melt outlet channel, e.g. in the front outlet region of the mouthpiece body or, in the case of hot runner systems, in the mould-side outlet channel portion of the melt outlet channel directly in front of the mould cavity or the gate region opening into the mould cavity, are also known. If the melt outlet channel branches in the mould-side outlet channel portion, as is customary in hot runner systems, each channel branch preferably has its own closure nozzle. A closure nozzle is to be understood in this case to mean a nozzle-shaped mouth region of the melt outlet channel that can be closed in particular during the refilling phase of a casting process and/or before the casting mould is opened and the cast part is removed or expelled, such that the melt outlet channel is closed in these periods of time. In this way, unintentional flowing of melt material out of the melt outlet channel and/or unintentional flowing back of melt material in the melt outlet channel in the direction of the casting chamber is intended to be prevented. To this end, this nozzle-shaped mouth region, i.e. the closure nozzle, may be configured to form, in a cooling phase of the casting process before the casting mould is opened, a melt plug from solidified or partially solidified melt material, said melt plug closing the melt outlet channel. This technique is used for example in what is known as plug casting. Additionally or alternatively, this nozzle-shaped mouth region, i.e. the closure nozzle, may contain an actuable, moveable nozzle channel closing body as mechanical closure element by means of which the melt outlet channel can be closed. Laid-open publications WO 2013/071926 A2 and WO 2017/148457 A1 disclose die-casting machines of this kind, the closure nozzle of which is designed to form a melt plug and may optionally additionally have a nozzle channel closing body which is provided by a non-return valve.

A further aspect generally to be considered in the case of die-casting machines of the present type is the minimization of wear effects of the oppositely situated walls of casting piston and casting chamber as a result of the stroke movement of the casting piston in the casting chamber, in particular if it is of the spool type.

The invention is based on the technical problem of providing a die-casting machine and an associated operating method of the type mentioned at the outset, which offer advantages over the abovementioned prior art in particular in terms of achieving relatively short casting cycle times and/or a relatively low air porosity in the cast part and/or in terms of a relatively low tendency to wear of casting piston and casting chamber.

The invention solves this problem by providing a method for operating a die-casting machine, and a die-casting machine, having the features of the independent claims. Advantageous refinements of the invention, which contribute to solving this and further problems, are specified in the dependent claims, the content of which, including all combinations of features indicated by the claim back-references, is hereby fully incorporated by reference into the description.

The die-casting machine of the invention comprises a casting mould, a casting chamber, a casting piston arranged in an axially moveable manner in the casting chamber, a melt inlet channel leading into the casting chamber and having a shut-off valve, and a melt outlet channel leading from the casting chamber to the casting mould.

In the operating method according to the invention, for carrying out a respective casting process, in a mould-filling phase, with the shut-off valve being closed, the casting piston in the casting chamber is advanced from a casting start position to a filling end position so as to press melt material into the casting mould via the melt outlet channel and, in a subsequent refilling phase, with the shut-off valve being open, the casting piston is moved back to the casting start position so as to supply the casting chamber with melt material via the melt inlet channel. Further, a closure nozzle, which is kept closed in the refilling phase, is used in the melt outlet channel. In the mould-filling phase, with the shut-off valve remaining closed, the casting piston is firstly moved back from the casting start position to an additional stroke position and subsequently advanced from the additional stroke position via the casting start position to the filling end position, wherein the closure nozzle is kept closed during the return movement of the casting piston into the additional stroke position and is only opened when the casting piston advances again.

In this case, depending on requirements, the opening of the closure nozzle can be commenced at a point in time at which the casting piston, during its advance, has reached its casting start position again or before it has reached said position or only after it has already overrun said position. Here, the casting start position is the position into which the casting piston has moved back during the refilling phase of a preceding casting process and which represents an initial position or basic position of the casting piston for the start of the next casting process. Since the shut-off valve is switched over from its open valve position to its closed valve position at the end of the refilling phase, this casting start position can also be referred to as a valve switchover position of the casting piston, i.e. it is the position in which the casting piston is located when the shut-off valve is switched over to its closed valve position. In the case of a melt outlet channel that branches, e.g. in the case of a corresponding hot runner system, each channel branch preferably has its own closure nozzle, i.e. the presence of a closure nozzle as mentioned in the present case is self-evidently to be understood to the effect that, depending on the system configuration, one or more closure nozzles may be assigned to the melt outlet channel.

This procedure according to the invention advantageously combines controllable opening and closing of the melt inlet channel by means of the shut-off valve with controllable opening and closing of the melt outlet channel by means of the closure nozzle, in each case during specific periods in time in the course of a casting process.

The measure of keeping the closure nozzle of the melt outlet channel closed in the refilling phase has the effect that the melt outlet channel remains pre-filled with melt material as far as the closure nozzle when the casting chamber is refilled with melt material via the open shut-off valve in the refilling phase. In this way, the system is already pre-filled for the next casting cycle without further pre-filling measures being required for this purpose.

The measure of firstly moving the casting piston back to the additional stroke position at the beginning of a next casting cycle and still keeping the shut-off valve closed in the process, wherein the closure nozzle is also still kept closed, has the effect that an additional stroke is gained for the casting piston, said additional stroke being able to be used for the subsequent acceleration of the casting piston for its advancing movement in the further course of the mould-filling phase. As a result of the return movement of the casting piston to the additional stroke position in the case of a closed shut-off valve and a closed closure nozzle, a negative pressure is created in the melt outlet channel behind the closure nozzle, said negative pressure being released again by the subsequent advance of the casting piston out of its additional stroke position and allowing the casting piston to accelerate forward on this acceleration path without appreciable counterforce.

In this way, in terms of its advancing movement, the casting piston can be accelerated in an effective and functionally advantageous manner to a desired high speed, already before it then reaches its casting start position again, and subsequently continues to move at this high speed as far as the filling end position in order to press the melt material into the casting mould. In this case, the additional stroke position and, as a result, the settable acceleration path for the casting piston can be freely selected in a continuously variable manner depending on requirements. With increasing additional stroke, i.e. greater difference between additional stroke position and casting start position or valve switchover position, the acceleration path for the casting piston that is available for the subsequent advance as far as the casting start position and the negative pressure in the melt outlet channel behind the closure nozzle increase correspondingly. Typically, the additional stroke can amount, for example, to between a few tenths of a percent and about 30% of the stroke of the casting piston from its casting start position to its filling end position.

By using the shut-off valve, it is not necessary for the casting piston to pass over an opening or inflow hole of the melt inlet channel into the casting chamber, which minimizes the wear for example on the casting piston and any associated piston rings. There is accordingly also no risk of piston rings being pressed, owing to the melt pressure, into the inflow hole, as can occur in conventional casting systems in which the casting piston passes over such an inflow hole. In the present case, the piston rings of the casting piston are in the melt space or pressure space of the casting chamber at any given point in time and can thus be kept free from significant changes in loading.

In a refinement of the invention, the refilling phase begins after a follow-up pressure phase, which is subsequent to the mould-filling phase, during a cast part cooling phase, with the return movement of the casting piston, wherein the shut-off valve is already opened at the beginning of the refilling phase. This measure makes it possible to start the refilling phase directly after completion of the customary follow-up pressure phase, which is subsequent to the mould-filling phase, with the introduction of melt material into the casting chamber. As an alternative, the shut-off valve may also be opened in a delayed manner e.g. in relation to the start of the return movement of the casting piston, as a result of which a certain suction pressure can be generated as required in the casting chamber for the purpose of suctioning the melt material out of the melt bath after the shut-off valve has been opened.

In a refinement of the invention, the closing of the closure nozzle comprises a melt plug formation process, and the opening of the closure nozzle comprises a melt plug removal process. The implementation of these processes for formation of a melt plug for the purpose of closing the closure nozzle and for removal of the previously formed melt plug for the purpose of opening the closure nozzle is known per se, wherein any desired conventional implementation can be used in the present case.

In a refinement of the invention, the opening and closing of the closure nozzle comprises a corresponding controlled actuation of a nozzle channel closing body. This may be provided instead of or in addition to the formation of a melt plug as mentioned above. Once again, any of the implementations which are known per se for this measure can be used for this. The mechanically moveable nozzle channel closing body which can be actuated, for example, via the control unit may be for example a closure ball or closure needle customary for this.

In a refinement of the invention, the shut-off valve used is a shut-off control valve which can be controlled by the control unit or a non-return valve which is preloaded in its closed position. The use of a controllable shut-off valve permits controlled opening and closing of the shut-off valve by the control unit at freely predefinable points in time. When using a non-return valve as shut-off valve, the movement of the casting piston is suitably matched to it such that the non-return valve opens or closes at the respectively desired point in time under the action of the melt pressure acting on it.

In addition to the components of the considered generic machine type which are mentioned at the outset, the die-casting machine according to the invention contains the closure nozzle, i.e., as mentioned above, a single closure nozzle or multiple closure nozzles, in the melt outlet channel, as is known per se for the other conventional machine type mentioned above for this purpose. For the purpose of carrying out a respective casting process, the control unit and the shut-off valve are configured, for a mould-filling phase, to bring the shut-off valve into a closed position, and to control the casting piston in the casting chamber to advance from a casting start position to a filling end position, in order to press melt material into the casting mould via the melt outlet channel, and, for a subsequent refilling phase, to bring the shut-off valve into an open position and to control the casting piston to move back to the casting start position, in order to supply the casting chamber with melt material via the melt inlet channel. The control unit, the shut-off valve and the closure nozzle are further configured to keep the closure nozzle closed in the refilling phase and, in the mould-filling phase, with the shut-off valve remaining closed, to firstly move the casting piston back from the casting start position to an additional stroke position and to subsequently advance it from the additional stroke position via the casting start position to the filling end position, and at this time to keep the closure nozzle closed during the return movement of the casting piston to the additional stroke position and to only open it when the casting piston advances again. In this case, depending on requirements, the opening of the closure nozzle can be commenced already before the casting piston has reached its start position again or precisely at this point in time or only afterwards. As a result, this die-casting machine is suitable in particular for carrying out the operating method according to the invention.

In a refinement of the invention, the closure nozzle has a melt-plug-forming nozzle part. This permits closing of the closure nozzle by the local formation of a melt plug.

In a refinement of the invention, the closure nozzle has a nozzle part which can be varied in a controllable manner in terms of its passage cross section. This may be for example a mechanically moveable nozzle channel closing body, such as a closure ball or a closure needle.

In a refinement of the invention, the shut-off valve is in the form of a shut-off control valve which can be controlled by the control unit. This allows active control of the shut-off valve by means of the control unit, in particular in order to bring it into its respectively desired open or closed position in the course of a casting process.

In a development of the invention, the die-casting machine contains a valve actuator, activated by the control unit, for actuating the shut-off control valve. The actuator functions as a linking element between the control unit and the shut-off valve and may be suitably selected depending on the type of the control unit and the shut-off valve, e.g. of an electrical, magnetic, hydraulic, pneumatic or mechanical type. As an alternative, the valve actuation functionality may be integrated e.g. directly in the control unit.

In an alternative refinement of the invention, the shut-off valve is in the form of a non-return valve which is preloaded in its closed position. This constitutes an alternative to the implementation as a shut-off control valve. In this case, the shut-off valve is controlled or actuated in dependence on the pressure of the melt material acting on it, in particular on the melt pressure in the casting chamber.

In a refinement of the invention, the die-casting machine contains a valve sensor unit for sensing one or more measured variables of the shut-off valve and/or of the closure nozzle. This can be used e.g. to give feedback about the current position of the shut-off valve and/or about the current state of the closure nozzle to the control unit by way of the valve sensor unit and/or to provide valve and/or nozzle diagnosis information which provides information as to whether the shut-off valve and/or the closure nozzle is/are operating in an error-free manner and/or in which state of use it/they is/are located and whether it/they requires/require e.g. maintenance.

Advantageous embodiments of the invention are illustrated in the drawings. These and other embodiments of the invention are explained in more detail below.

DETAILED DESCRIPTION OF THE DRAWINGS

Figure 1:
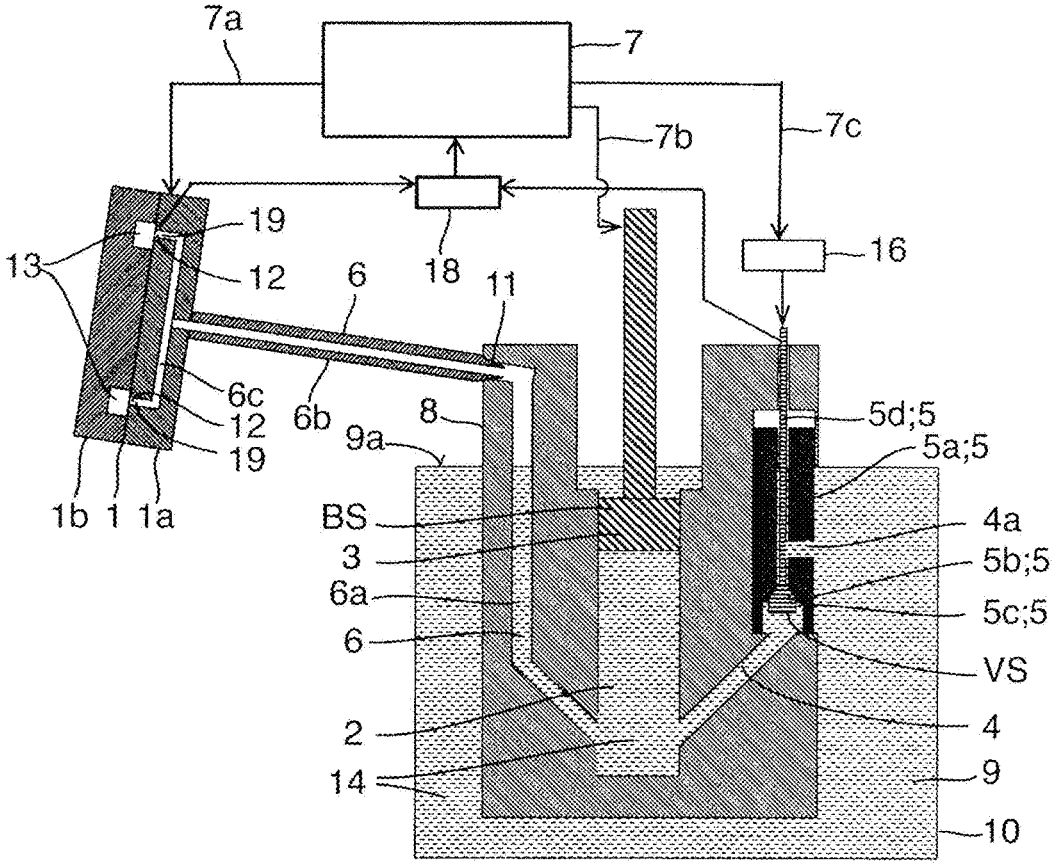
FIG. 1 is a schematic illustration of a part, of interest in the present case, of a die-casting machine.

FIG. 1 schematically illustrates a part of interest here of a die-casting machine in an implementation according to the invention, which can be operated by way of the operating method according to the invention. This die-casting machine may be in particular one of the hot-chamber type for die casting liquid or partially liquid metal melts, such as zinc, lead, aluminium, magnesium, titanium, steel, copper, and alloys of these metals. For this purpose, the die-casting machine comprises in particular a casting mould 1 which has a fixed mould half 1*a* and a moveable mould half 1*b*, a casting chamber 2, a casting piston 3 arranged in an axially moveable manner in the casting chamber 2, a melt inlet channel 4 which leads into the casting chamber 2, a shut-off valve 5 in the melt inlet channel 4, a melt outlet channel 6 which leads from the casting chamber 2 to the casting mould 1, a closure nozzle 19 in the melt outlet channel 6, and a control unit 7.

In the example shown, the shut-off valve 5 is configured as a shut-off control valve, i.e. as an activatable shut-off valve, which is activated by the control unit 7 directly or, as in the example shown, by way of an optional valve actuator 16. The valve actuator 16 may be any desired actuator of the conventional type, as is known to a person skilled in the art for actuating such a valve per se. In this respect, depending on requirements and the usage situation, the actuator 16 may be in particular of a conventional electrically operating, hydraulically operating, pneumatically operating or mechanically directly operating actuator type, or an actuator type which operates mechanically by way of a lever system etc. In this respect, depending on requirements and the usage situation, the valve actuator 16 may be an actuator type which operates in a purely binary manner and switches over the shut-off valve 5 only between a first, open position and a second, closed position, or alternatively a proportional actuator type, which can open the shut-off valve 5 continually or in multiple stages, i.e. can also bring the shut-off valve 5 into one or more partial opening positions between its completely open position and its completely closed position and keep it there. For this purpose, as required, the valve actuator may comprise e.g. variably settable end stops, which can be adjusted manually or automatically. In an alternative implementation of the die-casting machine, the shut-off valve 5 is formed by a non-return valve.

In the present case, the control unit 7 is understood to mean encompassing all control elements of the die-casting machine for controlling and/or regulating the various components of the machine, for which purpose the control unit 7, depending on the system configuration, may contain a single control device in which all control functionalities are integrated, or a plurality of single control devices, each of which controls and/or regulates specific machine components and which preferably have a communication link with one another. Similarly, as is customary, the control unit 7 may be configured at least partially in hardware and/or at least partially as software. Shown purely symbolically and in a representative manner to illustrate all machine control functionalities of the control unit 7 are activation arrows 7*a*, 7*b*, 7*c* which lead from the control unit 7 to the casting mould 1, to the casting piston 3 and to a valve rod 5*d* of the shut-off valve 5, respectively, the control functions belonging to these machine components being of primary interest in the present case. For the sake of simplicity, the schematic illustration of the control unit 7 is only present in FIG. 1; by contrast, it is omitted in FIGS. 3 to 6, 8 and 9.

Unless referred to in more detail below, both the control unit 7 and the rest of the machine components mentioned have a structure which is conventional per se and familiar to a person skilled in the art, and therefore requires no further explanation here. In the example shown, as can be seen e.g. in FIG. 1, the casting chamber 2 is formed in a casting container 8 of a casting unit which is customary in this respect, the casting container 8 being immersed in a melt bath 9 located in a conventional melt container 10 during the casting operation.

In the example shown, the shut-off valve 5 is held on the casting container 8 by means of a valve housing body 5*a*. Located on the valve housing body 5*a*, as an alternative at a different position on the casting container 8, are one or more inlet openings in the form of an ingress 4*a* for the melt inlet channel 4, i.e. melt material 14 can pass from the melt bath 9 via the ingress 4*a* into the melt inlet channel 4. The shut-off valve 5 is located specifically with a fixed valve seat 5*b* and a moveable valve closing body 5*c* in the melt inlet channel 4, it being possible in the example shown for the valve closing body 5*c* to be moved so as to rest axially against the valve seat 5*b* and away from it by way of the valve rod 5*d*, in order to close and open the shut-off valve 5, respectively, i.e. to switch it over between a closed position VS shown e.g. in FIG. 1 and an open position VO shown e.g. in FIG. 4. In this respect, depending on the valve configuration and/or operating situation, the open position VO may be a completely open position or a partially open position of the valve. In alternative embodiments, not shown, the shut-off valve 5 is arranged in the casting piston 3, in this case the melt inlet channel 4 leading via the casting piston 3, in particular through it, as is known per se.

In the machine configuration shown, as already mentioned, the switchover movement of the shut-off valve 5, i.e. the shut-off control valve, is performed by the control unit 7 by way of the optional valve actuator 16. In the alternative machine configuration, not shown, having the non-return valve as shut-off valve 5, the switchover movement of the shut-off valve 5 is performed in dependence on the melt pressure in the casting chamber 2, the non-return valve being preloaded in its closed position by a preloading unit of the conventional type in a preferred implementation. When a corresponding melt negative pressure is present in the casting chamber 2, the shut-off valve 5 formed in this case as a non-return valve is moved from its closed position VS to its open position VO by this negative pressure counter to the preload force of the preloading unit. As soon as the melt negative pressure is no longer present, the non-return valve returns automatically to its closed position VS by virtue of the action of the preloading unit. The preloading unit may be implemented e.g. by a preload spring, such as a correspondingly designed and arranged compression or tension spring.

The melt outlet channel 6 leads in a conventional manner out of the casting chamber 2 via a riser-channel region and/or riser-tube portion 6*a* formed in the casting container 8 and then continues via a mouthpiece body 6*b* to the region of the mould 1. For this purpose, in a likewise conventional manner, the mouthpiece body 6*b* is coupled on the inlet side to a mouthpiece attachment 11, with which the riser-tube portion 6*a* opens out of the casting container 8, and guided on the outlet side as far as the fixed mould half 1*a*. In the fixed mould half 1*a*, a mould-side outlet channel portion 6*c* of the melt outlet channel 6 runs as far as a mould cavity 13, which, when the casting mould 1 is closed, is formed by the two mould halves 1*a*, 1*b* and is designed in dependence on the cast part to be produced.

In this case, the melt outlet channel 6 opens by way of a gating cone or nozzle-shaped front outlet region 12 of a design known per se into the mould cavity 13, wherein, in this region 12, a closure nozzle 19 is formed in one of the implementations known per se for this. To this end, depending on requirements and the usage situation, the closure nozzle 19 contains a melt-plug-forming nozzle part and/or a nozzle part which can be varied in a controllable manner in terms of its passage cross section; in the first-mentioned case typically using a suitably shaped nozzle-shaped mouth region of the melt outlet channel 6 and assigned melt temperature-control means acting on the nozzle region, and in the last-mentioned case typically using an actuable, moveable mechanical nozzle channel closing body, such as a closure ball or a closure needle.

In the example shown, the die-casting machine has a hot runner system in which the melt outlet channel 6 divides in the mould-side outlet channel portion 6*c* into a plurality of parallel branches, wherein a respective assigned closure nozzle 19 is provided in the outlet-side end region of each branch. In an alternative machine configuration, as can be used e.g. for the plug casting of magnesium, the closure nozzle 19 is arranged in the outlet-side end region of the mouthpiece body 6*b*, which in that case opens into the mould cavity 13 preferably in an unbranched manner via a gating cone as mould-side outlet channel portion 6*c* of the melt outlet channel 6 in the fixed mould half 1*a*.

Figure 2:
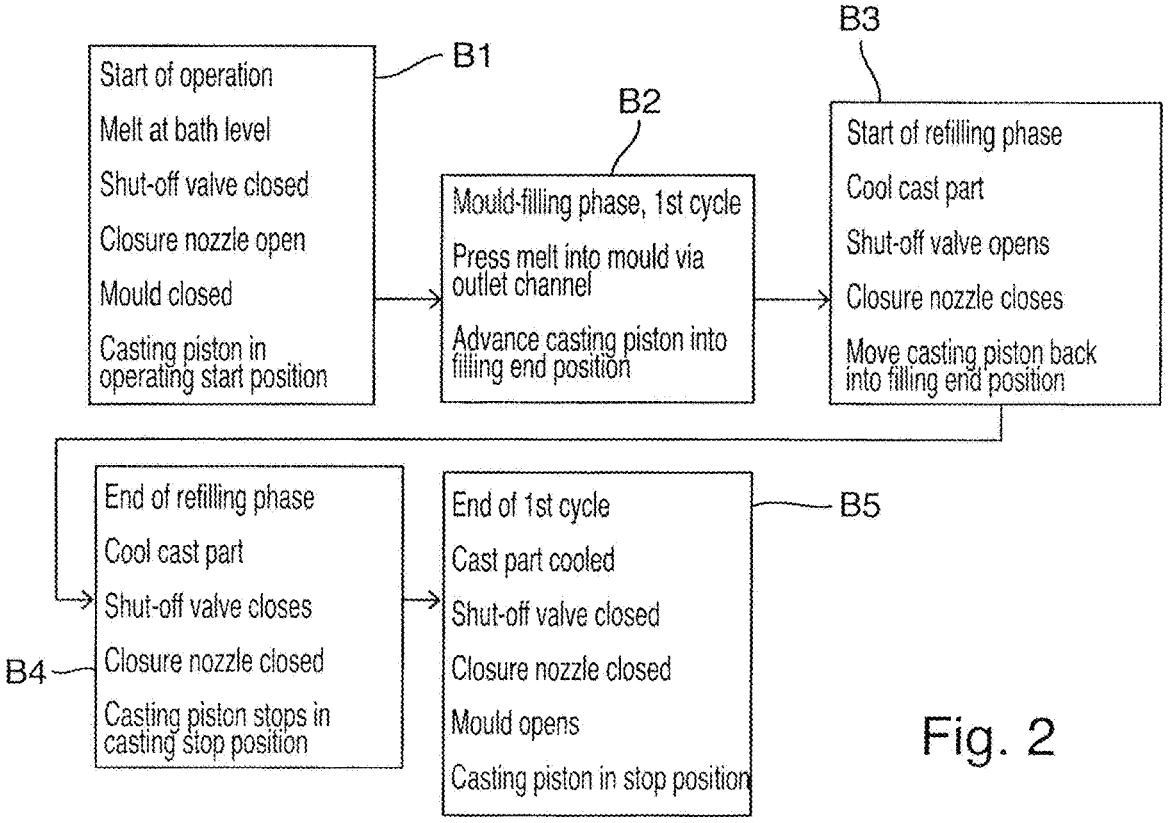
FIG. 2 is a flow diagram of a first casting cycle of a method for operating a die-casting machine from a start of operation.

FIG. 2 illustrates the operating method according to the invention in an exemplary embodiment variant at a start of operation of the die-casting machine, i.e. after starting the machine for the purpose of casting a desired number of identical cast parts in a corresponding number of casting processes or casting cycles which follow one another. FIGS. 1 and 3 to 6 illustrate the machine schematically in different operating stages during the operation according to the embodiment variant from FIG. 2.

In an initial operating stage B1 from FIG. 2, the machine is in a basic state at the start of operation. FIG. 1 shows the machine in this operating stage B1. The casting piston 3 is accordingly located in an operating start position BS. The melt material 14 is present everywhere at the height of a melt bath level 9*a* of the melt bath 9, i.e. also in the melt outlet channel 6. Consequently, a middle and front region of the riser-channel portion 6*a*, the mouthpiece body 6*b* and the mould-side outlet channel portion 6*c* are still free of melt material 14. The closure nozzle 19 is open, the shut-off valve 5 is in its closed position VS, and the casting mould 1 is closed.

Figure 3:
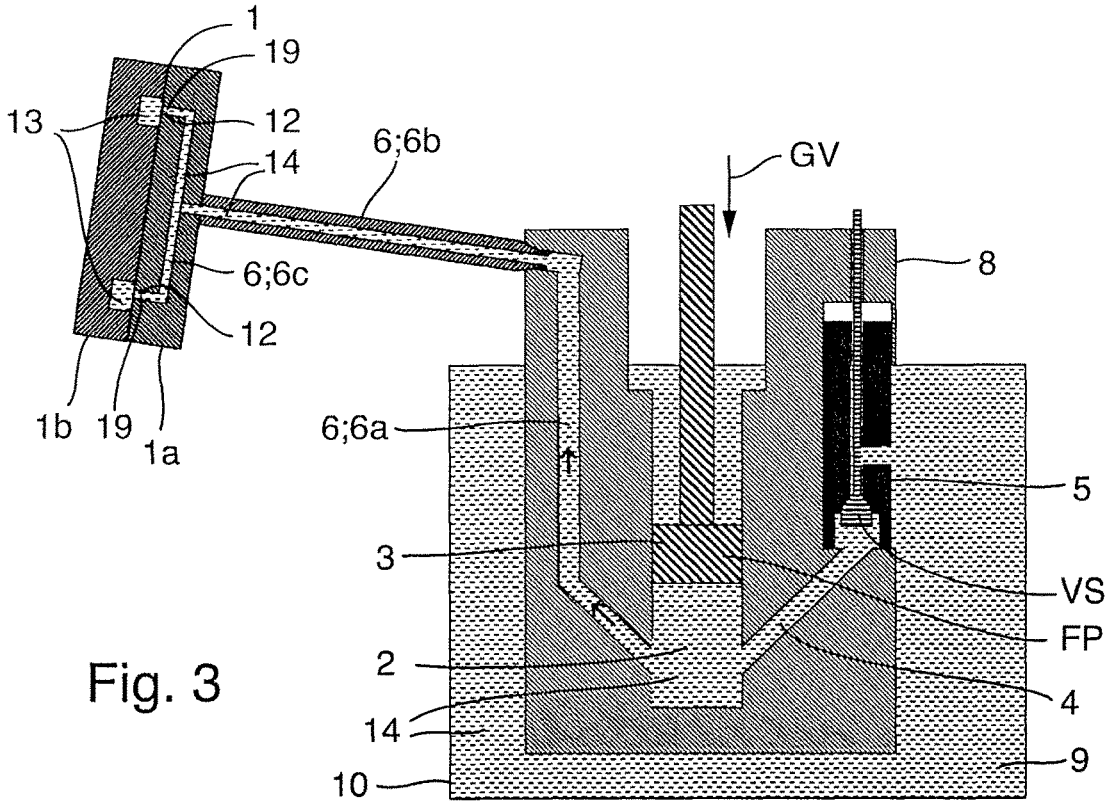
FIG. 3 is a schematic illustration of the die-casting machine from FIG. 1 during operation according to the method from FIG. 2 towards the end of a mould-filling phase of the first casting cycle.

In a subsequent operating stage B2 from FIG. 2, a first casting cycle is initiated, and an associated mould-filling phase is carried out for this. FIG. 3 shows the machine at this point in time. For this purpose, the casting piston 3 is advanced from the operating start position BS to a filling end position FP, i.e. downwards in each of FIGS. 1 and 3 to 6, with the result that melt material 14 is pressed from the casting chamber 2 via the melt outlet channel 6 into the casting mould 1 or the casting cavity 13. The advancing movement of the casting piston 3 is symbolized in FIG. 3 by an associated movement direction arrow GV. The melt flow in the melt outlet channel 6 is indicated in FIG. 3 symbolically by corresponding flow arrows, FIG. 3 showing the machine specifically towards the end of this mould-filling phase, which in a known manner may end with what is known as a follow-up pressure phase, in which an additional, increased follow-up pressure is exerted on the melt material 14 in the mould 1.

In an operating stage B3 from FIG. 2, the mould-filling phase is ended and a refilling phase and/or piston return phase follows. For this purpose, the shut-off valve 5 is switched over from its closed position VS into its open position VO, and the casting piston 3 is moved back out of its filling end position FP, i.e. upwards in the relevant figures. The switching over of the shut-off valve 5 takes place controlled by the control unit 7 in the case of the shut-off control valve, and by the melt negative pressure which is produced in the casting chamber 2 on account of the return movement of the casting piston 3 in the case of the non-return valve. It may be mentioned here that naturally, depending on the machine type, the advancing or return movement of the casting piston 3 may be oriented not in the vertical direction, as in the example shown, but rather perpendicularly or inclined with respect to the vertical direction.

Figure 4:
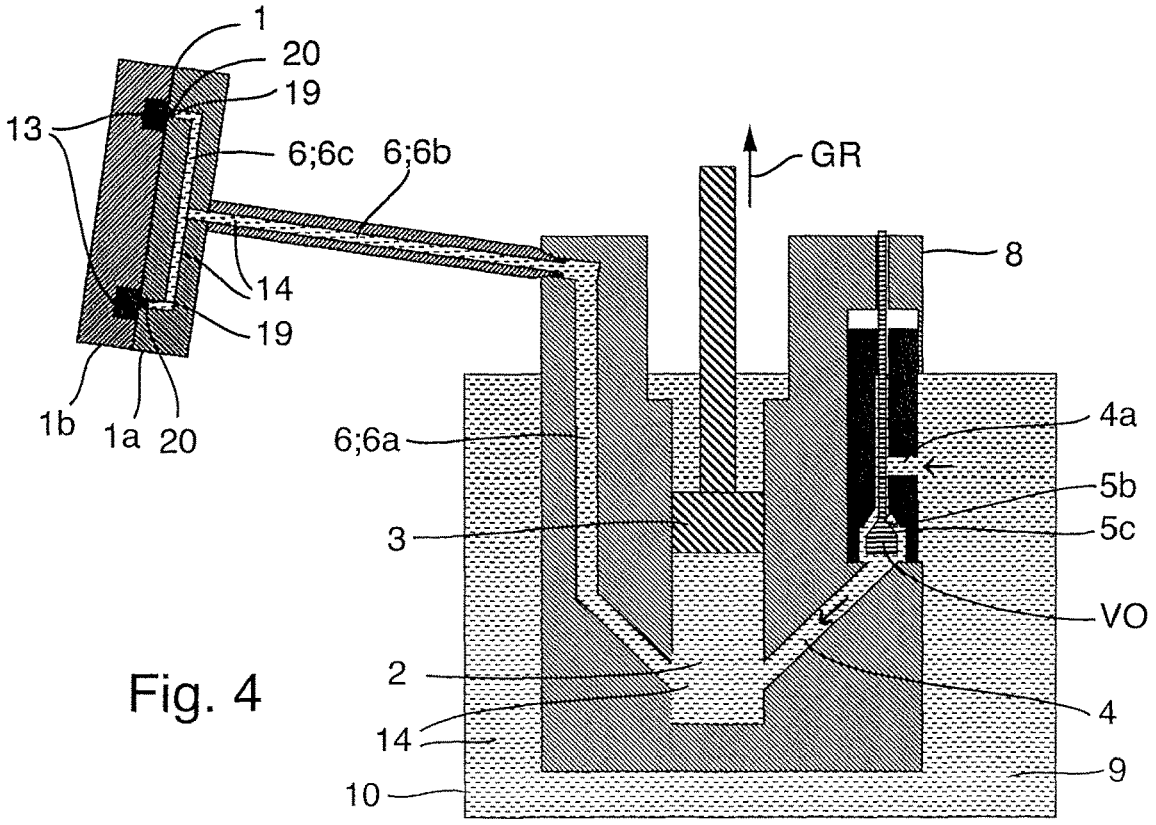
FIG. 4 is the view from FIG. 3 during a refilling phase after the mould-filling phase.

The casting mould 1 initially remains closed, and what is known as the cooling time passes, during which the melt material 14 in the mould cavity 13 is cooled, with the result that the melt material 14 which solidifies there forms a desired cast part 15. At the same time, the closure nozzle 19 is closed, e.g. mechanically via the corresponding activation of the nozzle channel closing body by the control unit 7 and/or, as shown, by a melt plug 20 which forms at the location of the closure nozzle 19 as a result of the cooling of the melt material in the casting cavity 13 or the casting mould 1. The return movement of the casting piston 3 sucks and thus refills melt material 14 from the melt bath 9 via the melt inlet channel 4 into the casting chamber 2. FIG. 4 shows the machine in this period of the refilling phase, in which melt material 14 from the melt bath 9 refills the casting chamber 2 via the melt inlet channel 4, as illustrated by corresponding flow arrows. The return movement of the casting piston 3 is symbolized in FIG. 4 by an associated return movement arrow GR.

Figure 5:
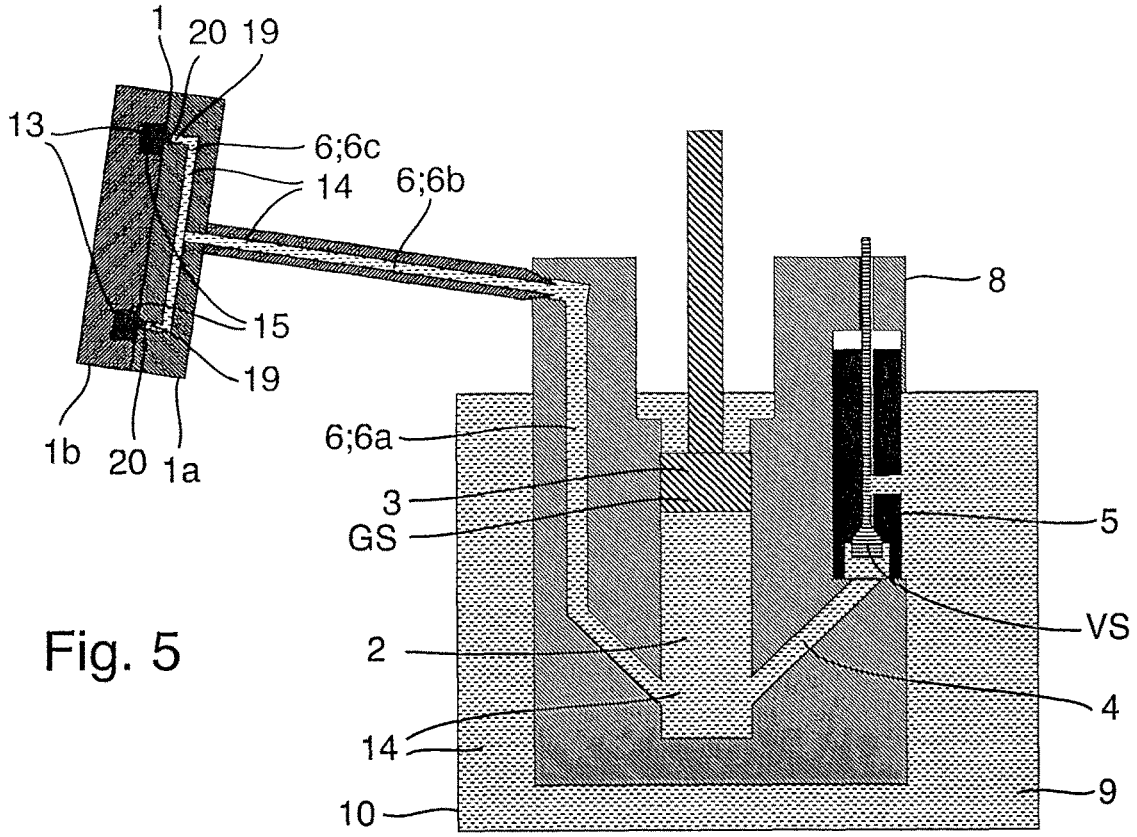
FIG. 5 is the view from FIG. 3 at the end of the refilling phase.

In an operating stage B4 from FIG. 2, the refilling of the casting chamber 2 with melt material 14 from the melt bath 9 via the melt inlet channel 4 is ended by stopping the return movement of the casting piston 3 upon reaching a casting piston stop position or casting stop position for short or simply stop position, and by switching over the shut-off valve 5 from its open position VO into its closed position VS. The casting piston stop position can therefore also be referred to as valve switchover position of the casting piston 3, i.e. as the position which the casting piston 3 occupies at the time of the switchover of the shut-off valve 5 into its closed position VS. The extent of return movement of the casting piston 3 from its filling end position FP in the refilling phase and consequently the stop position or valve switchover position of the casting piston 3 can be freely selected as required and are based in particular on how much melt material is required for the production of a respective cast part, i.e. how large the volume of the cast part is and how much melt material consequently has to be refilled into the casting chamber for the next casting cycle. In other words, the valve switchover position is at least so far behind the filling end position that the refilling phase refills the casting chamber 2 with the volume of melt that corresponds to the volume of the cast part. The switching of the shut-off valve 5 over into its closed position VS is brought about, in the case of the shut-off control valve, by the control unit 7, and in the case of the non-return valve, in that due to the stopping of the return movement of the casting piston 3, a melt negative pressure is no longer generated in the casting chamber 2, with the result that the non-return valve returns automatically to its closed position VS by virtue of its preloading unit. The casting piston stop position of the casting piston 3 represents a casting start position GS or initial or basic position in which the casting piston 3 can remain until the start of a next casting cycle and in which it is consequently located when the next casting cycle starts. FIG. 5 shows the machine at this point in time. Meanwhile, the cooling time for the melt material 14 in the casting mould 1 for the purpose of forming the cast part 15 continues.

Figure 6:
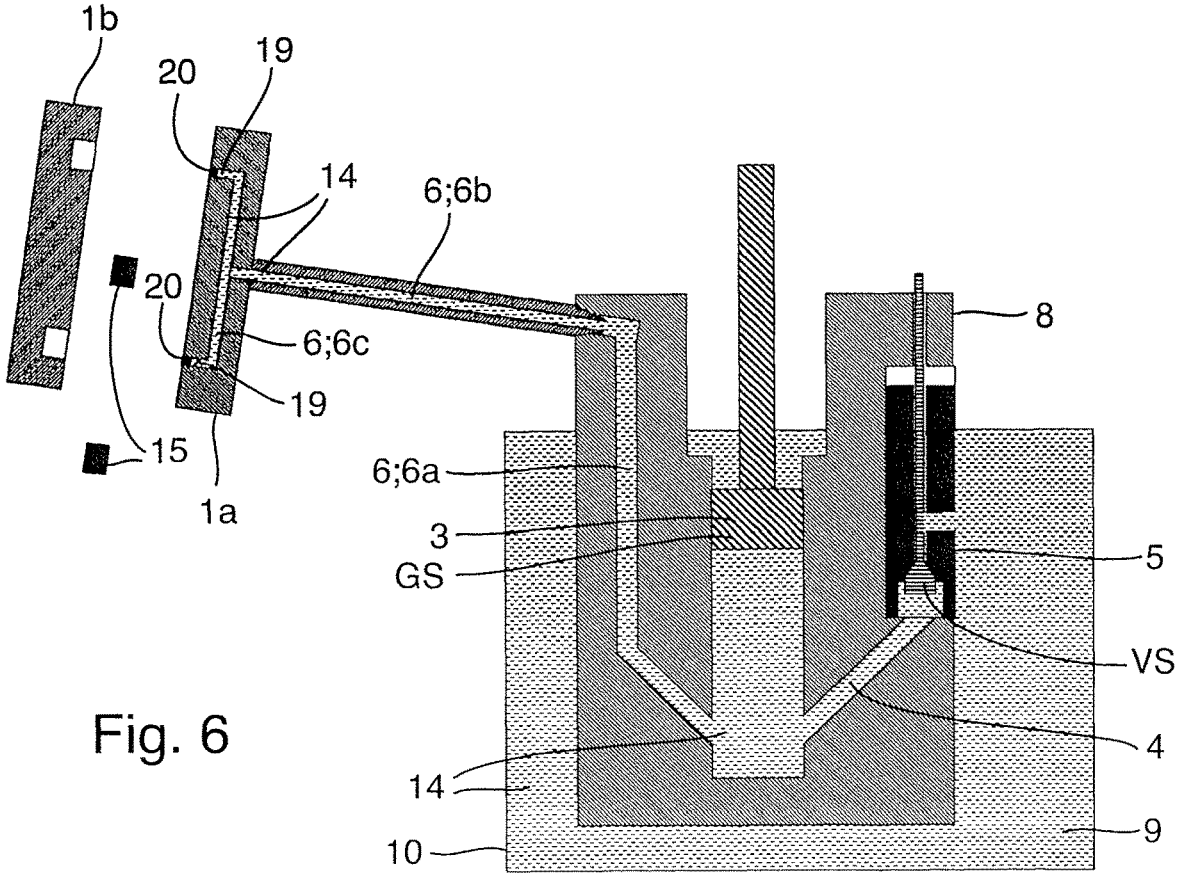
FIG. 6 is the view from FIG. 3 after a cooling phase has ended.

In an operating stage B5 from FIG. 2, the cooling time to the complete solidification of the formed cast part 15 in the mould 1 has then elapsed, and accordingly the casting mould 1 can be opened by virtue of a corresponding opening movement of the moveable mould half 1*b* and the formed cast part 15 can be removed and/or ejected or expelled. FIG. 6 illustrates the machine at this operating time. The first casting cycle after start of operation has thus ended. The melt outlet channel 6 remains closed on the outlet side by way of the closure nozzle 19 or the melt plug 20. This prevents melt material from flowing out of the melt outlet channel into the open mould. Equally, this prevents ingress of air on the mould-side into the melt outlet channel and the flowing back of melt material in the melt outlet channel. The melt material 14 thus remains in the entire melt outlet channel 6 from the casting chamber 2 as far as the outlet-side closure nozzle 19 or as far as the melt plug 20, i.e. the casting system is in a completely pre-filled operating state.

Figure 7:
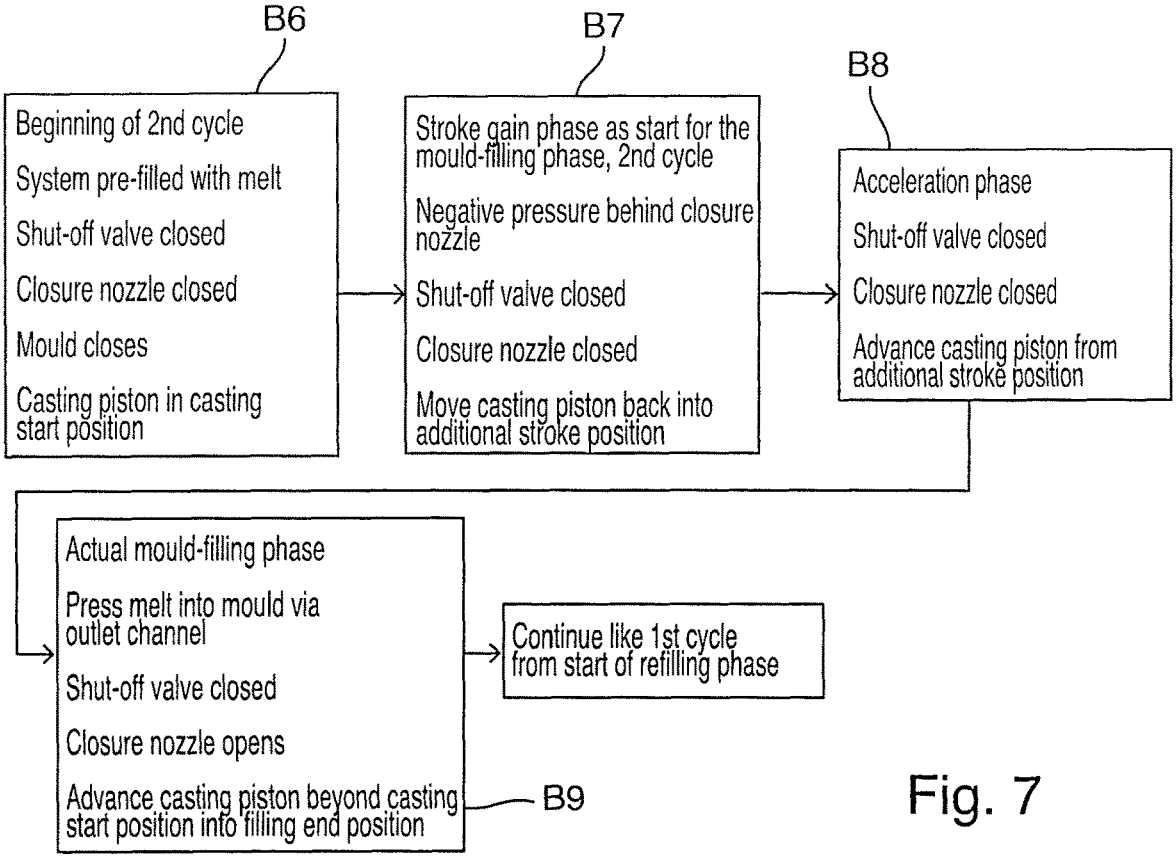
FIG. 7 is a flow diagram of a second casting cycle, following the first casting cycle according to FIG. 2, of the method for operating a die-casting machine.
Figure 8:
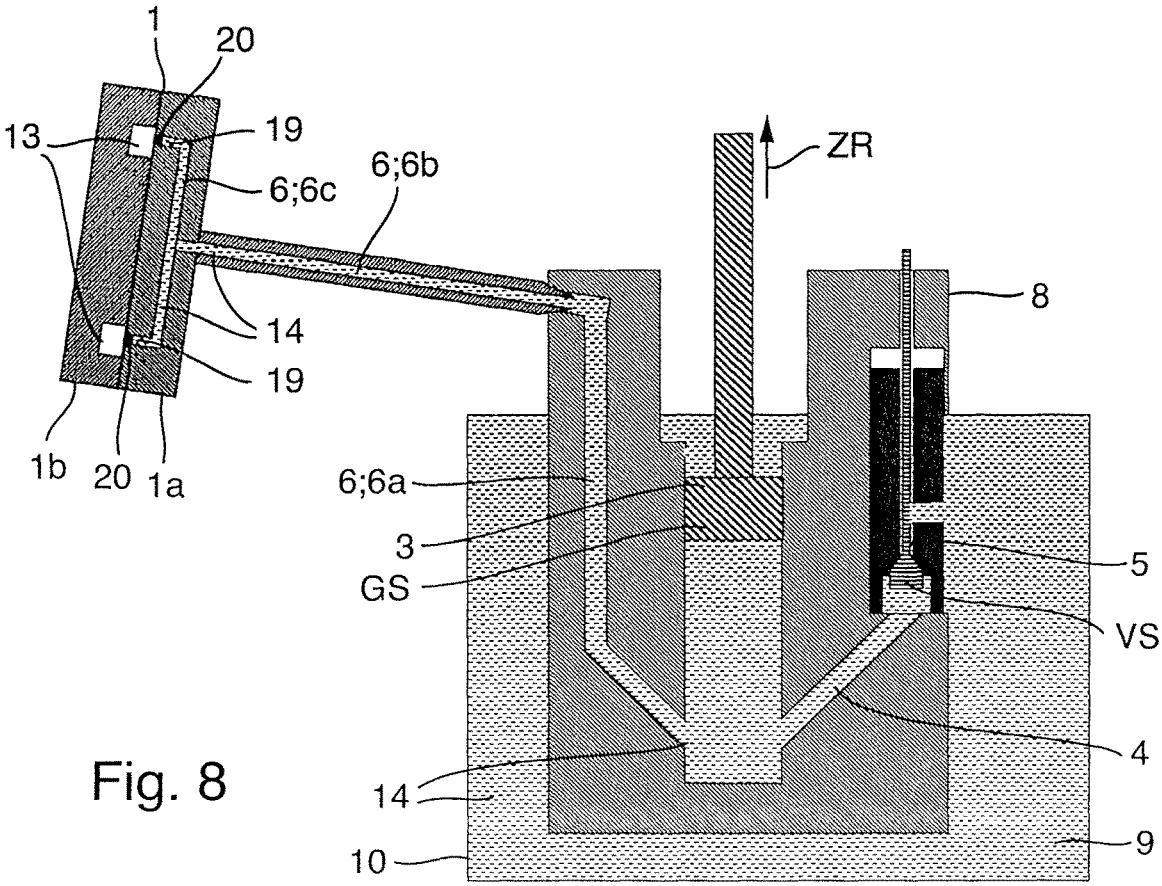
FIG. 8 is the view from FIG. 3 at the beginning of the second casting cycle according to FIG. 7 before a stroke gain phase.

FIG. 7 illustrates the performance of a next, second casting cycle. Initially, in an operating stage B6, the mould 1 is closed. The shut-off valve 5 is closed, and the closure nozzle 19 is also still closed. The casting system is in the mentioned, completely pre-filled state, and the casting piston 3 is in its casting start position GS as its stop position at the end of the refilling phase of the preceding first casting cycle. FIG. 8 shows the machine at this point in time.

Figure 9:
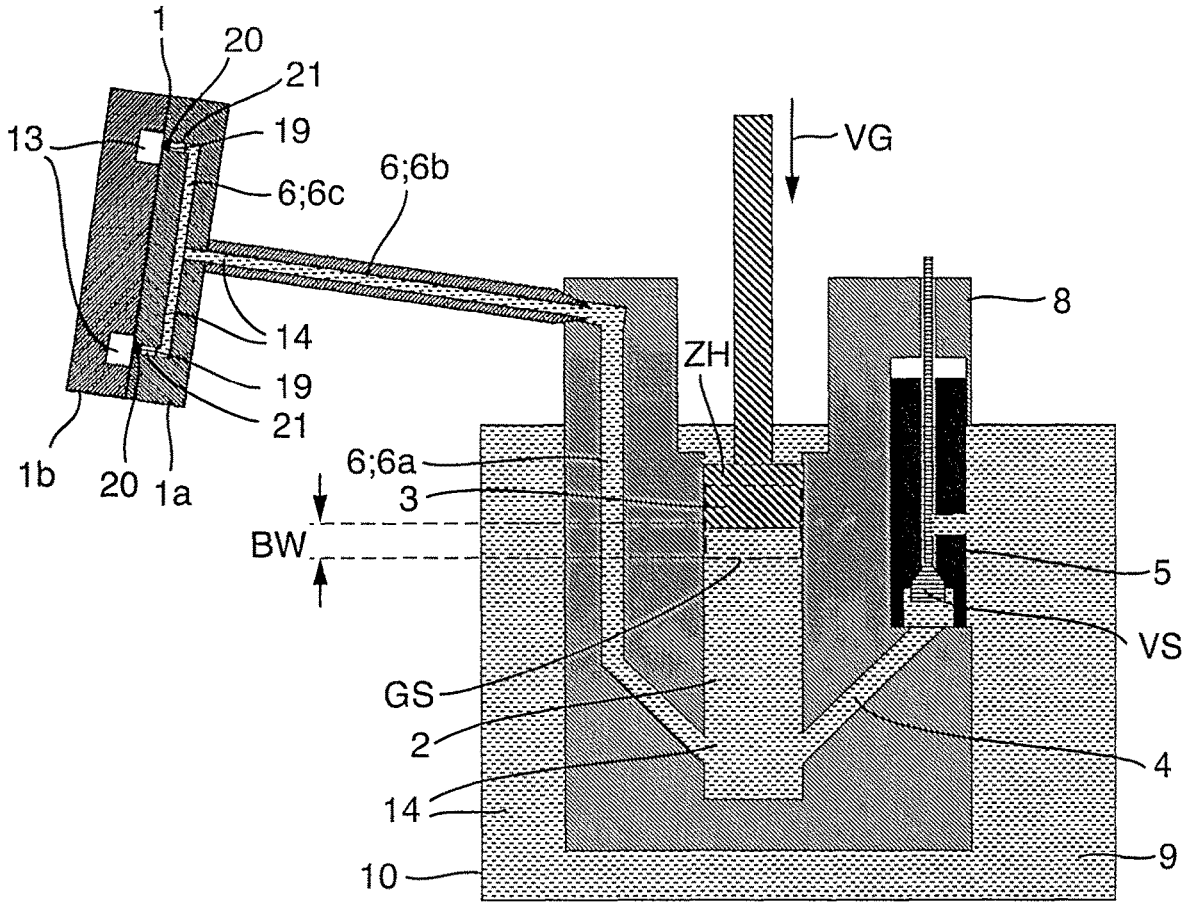
FIG. 9 is the view from FIG. 3 at the end of the stroke gain phase of the second casting cycle.

In this second casting cycle and every further casting cycle, as the start of the mould-filling phase or as the operating phase directly preceding the actual mould-filling process, a stroke gain phase is firstly carried out in which the casting piston 3 is moved back from the casting start position GS or valve switchover position to an additional stroke position ZH, wherein the shut-off valve 5 and the closure nozzle 19 remain closed. This is indicated in FIG. 7 as operating stage B7. In FIG. 8, this return movement of the casting piston 3 is symbolized by a return movement arrow ZR. FIG. 9 shows the machine at the end of this stroke gain phase. The casting piston 3 is located in the additional stroke position ZH by an additional stroke BW behind the casting start position GS, as illustrated in comparative fashion in FIG. 9. Since both the shut-off valve 5 and the closure nozzle 19, e.g. by way of the melt plug 20, are closed, this return movement of the casting piston 3 produces a certain negative pressure in the melt material 14 and especially in the melt outlet channel 6 directly behind the closure nozzle 19, symbolized by a vacuum bubble 21 in FIG. 9.

The additional stroke position ZH can be freely selected depending on requirements and can correspond e.g. to the operating start position BS of the first cycle, but alternatively also deviate from this, e.g. lie between this and the casting start position GS, i.e. the valve switchover position. The additional stroke BW typically amounts to between a few tenths of a percent and about 30% of the casting piston stroke distance of the filling end position FP from the casting start position GS, and in many cases approximately 5% to approximately 20% thereof.

The stroke gain phase is followed in an operating stage B8 from FIG. 7 by an acceleration phase for the casting piston 3, in which the latter is advanced out of its additional stroke position ZH, as symbolized by an advancing movement arrow VG in FIG. 9. In this case, the advance of the casting piston 3 is assisted by the previously formed negative pressure in the melt outlet channel 6, with the result that the casting piston 3 can be accelerated in the advancing direction practically without counterforces until the casting piston 3, after covering the corresponding additional stroke BW or acceleration path, has reached its casting start position GS again and the negative pressure in the melt outlet channel 6 has been released. In this way, the additional stroke BW can function as an acceleration path for the casting piston 3.

In an operating stage B9 from FIG. 7, the actual mould-filling phase is carried out in that the advancing movement of the casting piston 3 is continued beyond the casting start position GS and pressure is exerted on the melt material 14 in the casting chamber 2 and presses the melt material 14 into the mould 1 via the melt outlet channel 6 until the casting piston has reached its filling end position FP again. In this case, the closure nozzle 19 is opened, for which reason in particular the melt plug 20 which may have formed at the closure nozzle 19 is, in a conventional manner, also pressed out of the melt outlet channel 6 and/or broken up in a thermally assisted manner. Additionally or alternatively, in the case of a mechanical closure of the closure nozzle, this mechanical closure is opened. In the example of FIG. 7, the opening of the closure nozzle 19 and/or the breaking up of the melt plug 20 is carried out only at the beginning of the actual mould-filling phase after the acceleration phase. In alternative embodiments, this may have already been carried out during the acceleration phase or may have at least commenced then. In other words, depending on requirements, the opening of the closure nozzle 19 can be commenced at a point in time at which the casting piston 3, during its advance, has reached its casting start position GS again or before it has reached said position, i.e. during the acceleration phase, or only after it has already overrun its casting start position GS in the direction of the filling end position FP.

The casting process then proceeds with the start of the refilling phase as in the case of the first casting cycle described above. Further casting cycles following the second casting cycle can then be carried out in an identical manner to the second casting cycle.

The die-casting machine according to the invention is, as shown, configured for carrying out the operating method according to the invention. In particular, to this end, the control unit 7, the shut-off valve 5 and the closure nozzle 19 are correspondingly configured to carry out a respective casting process, wherein, for the purpose of carrying out the mould-filling phase, the shut-off valve 5 is kept closed, whether it be by corresponding control of the shut-off control valve directly or via the valve actuator 16 or automatically by keeping the non-return valve closed under the action of the melt pressure in the casting chamber 2, and the control unit 7 controls the casting piston 3 in the casting chamber 2 to move from its operating start position or its casting stop position or casting start position GS or its additional stroke position ZH to its filling end position FP, in order to press melt material 14 into the casting mould 1 via the melt outlet channel 6. In particular, the control unit 7, the shut-off valve 5 and the closure nozzle 19 are configured to keep the closure nozzle 19 closed in the refilling phase and, in the mould-filling phase, with the shut-off valve 5 remaining closed, to firstly move the casting piston 3 back from the casting start position GS into the additional stroke position ZH and to subsequently advance it from the additional stroke position ZH via the casting start position GS to the filling end position FP, and at this time to initially keep the closure nozzle 19 closed and to only open it when the casting piston 3 advances again.

As in the examples shown, the die-casting machine optionally has a valve sensor unit 18 for sensing one or more measured variables of the shut-off valve 5 and/or of the closure nozzle 19. The measured values with respect to the respective measured variable that are detected by the valve sensor unit 18 may be supplied to the control unit 7 as required, in order to provide it with control feedback about the current position of the shut-off valve 5 and/or the state of the closure nozzle 19. In addition or as an alternative, the measured values may be used for a diagnosis evaluation, in order to diagnose the current state of the shut-off valve 5 and/or of the closure nozzle 19, e.g. in terms of any malfunctions, and to identify when the shut-off valve 5 and/or the closure nozzle 19 needs maintenance.

Depending on requirements and the usage situation, the valve sensor unit 18 may comprise one or more sensors, including optional limit switches with or without a link to the control unit 7, which as already mentioned may be an entire machine control system of the die-casting machine or part of this machine control system. The valve sensor unit 18 may be configured to measure the stroke of the shut-off valve 5, for example, in order to derive an error diagnosis therefrom, e.g. whether the valve closing body 5*c* is torn off and the valve rod 5*d* overruns its intended position during the valve closing movement and/or whether the valve closing body 5*c* actually reaches its closed position or comes to a stop prematurely. The valve sensor unit 18 may optionally also comprise a force sensor in the valve rod 5*d* that measures the closing force or the contact pressure and/or the opening force of the valve closing body 5*c* for the purpose of diagnosis monitoring. In the case of an electrical or hydraulic and/or pneumatic valve drive e.g. by way of the valve actuator 16, for this monitoring purpose the valve sensor unit 18 may also comprise a flow sensor and/or pressure sensor of conventional design, whether it has a link to the control unit 7 or not.

As is made clear by the exemplary embodiments shown and the further exemplary embodiments explained above, the invention provides an advantageous method for operating a die-casting machine which makes it possible to achieve short casting cycle times, a lower air fraction in the cast part and/or a low tendency to wear of casting piston and casting chamber, wherein a shut-off valve in the melt inlet channel and a closure nozzle in the melt outlet channel are used in combination in a manner that is particularly advantageous in terms of method. The invention also provides a die-casting machine suitable for carrying out this operating method, which die-casting machine may be in particular of the hot-chamber type and suitable in particular for what is known as plug casting.

The invention claimed is:

1. A method for operating a die-casting machine which comprises a casting mould, a casting chamber, a casting piston arranged in an axially moveable manner in the casting chamber, a melt inlet channel leading into the casting chamber and having a shut-off valve, and a melt outlet channel leading from the casting chamber to the casting mould, the method comprising the steps of:

advancing the casting piston in the casting chamber for carrying out a respective casting process from a casting start position to a filling end position so as to press melt material into the casting mould via the melt outlet channel in a mould-filling phase with the shut-off valve being closed, and moving back the casting piston to the casting start position so as to supply the casting chamber with the melt material via the melt inlet channel in a subsequent refilling phase, with the shut-off valve being open; and moving back the casting piston in the mould-filling phase, with the shut-off valve remaining closed, from the casting start position to an additional stroke position and subsequently advancing the casting piston from the additional stroke position via the casting start position to the filling end position, and keeping a closure nozzle, which is provided in the melt outlet channel, closed in the refilling phase and during a moving back movement of the casting piston to the additional stroke position and opening the closure nozzle only when the casting piston advances again.

2. The method according to claim 1, comprising:

starting the refilling phase after a follow-up pressure phase, which is subsequent to the mould-filling phase, and during a cast part cooling phase, by the moving back movement of the casting piston, wherein the shut-off valve is already opened at the beginning of the refilling phase.

3. The method according to claim 1, comprising:

conducting a melt plug formation process by closing of the closure nozzle, and conducting a melt plug removal process by opening of the closure nozzle.

4. The method according to claim 1, wherein a controlled actuation of a nozzle channel closing body comprises opening and closing of the closure nozzle.

5. The method according to claim 1, wherein a shut-off control valve is used for the shut-off valve which is controllable by a control unit, or a non-return valve is used, which non-return valve is preloaded in its closed position.

* * * * *